US007562841B2

(12) United States Patent
Holden et al.

(10) Patent No.: US 7,562,841 B2
(45) Date of Patent: Jul. 21, 2009

(54) TEXTILE CARRIER HAVING IDENTIFICATION FEATURE AND METHOD FOR MANUFACTURING THE SAME

(75) Inventors: Harold A. Holden, Dandridge, TN (US); Thomas C. Brown, Parrottsville, TN (US); David E. Hungerpiller, Cohutta, GA (US)

(73) Assignee: Sonoco Development, Inc., Hartsville, SC (US)

( * ) Notice: Subject to any disclaimer, the term of this patent is extended or adjusted under 35 U.S.C. 154(b) by 262 days.

(21) Appl. No.: 11/456,987

(22) Filed: Jul. 12, 2006

(65) Prior Publication Data

US 2007/0012815 A1 Jan. 18, 2007

Related U.S. Application Data

(60) Provisional application No. 60/699,739, filed on Jul. 15, 2005.

(51) Int. Cl.
*B65H 75/14* (2006.01)

(52) U.S. Cl. ..... 242/610.1; 242/118.32; 493/299

(58) Field of Classification Search ..... 242/600, 242/610, 610.1, 610.4, 118, 118.3, 118.32, 242/613; 493/297–301; 428/34.2, 36.3, 428/167, 172; 138/104, 130, 122, 144, 150
See application file for complete search history.

(56) References Cited

U.S. PATENT DOCUMENTS

| | | | |
|---|---|---|---|
| 4,287,244 | A | 9/1981 | McMahon, Jr. et al. |
| 4,462,556 | A | 7/1984 | Graham, Jr. |
| RE33,060 | E | 9/1989 | Cummingham et al. |
| 4,889,294 | A | 12/1989 | Adams et al. |
| 5,393,582 | A | 2/1995 | Wang et al. |
| 5,472,154 | A | 12/1995 | Qiu et al. |
| 5,505,395 | A | 4/1996 | Qiu et al. |
| 6,066,373 | A | 5/2000 | Floyd, Jr. et al. |
| 6,435,436 | B1 | 8/2002 | Auten |

*Primary Examiner*—Peter M Cuomo
*Assistant Examiner*—William E Dondero
(74) *Attorney, Agent, or Firm*—Alston & Bird LLP

(57) ABSTRACT

A spirally wound tube for wrapping textiles or other materials thereon. The tube has an identification feature. The tube is made by spirally winding a number of plies together. The outermost ply defines a groove that substantially extends spirally along the length of the tube. The groove is for containing an identification marking for identifying the textile or other material wrapped onto the tube. In particular, the tube may include an identification stripe that extends along the groove. The identification stripe contains a marking system or identification markings to indicate the type or nature of the textile material wrapped on the tube. The marking system may include the color or colors of the stripe, or patterns, codes, readable indicia, or any combination of markings on the stripe.

25 Claims, 3 Drawing Sheets

TEXTILE CARRIER HAVING IDENTIFICATION FEATURE AND METHOD FOR MANUFACTURING THE SAME

CROSS-REFERENCE TO RELATED APPLICATIONS

This application claims priority to U.S. Provisional Application No. 60/699,739 filed on Jul. 15, 2005, which is hereby incorporated by reference in its entirety.

FIELD OF INVENTION

The present invention relates generally to a yarn carrier and, in particular, to a yarn winding tube for high speed winding operations. The present invention includes a spirally wound tube having an identification marking feature.

BACKGROUND OF THE INVENTION

During the yarn manufacturing process, yarn or other textile packages are formed by wrapping yarn onto yarn carriers or tubes that are rotated at high speeds, sometimes in excess of 8,000 rpm. Typically, the yarn carrier is rotated by a drive mechanism that includes a driven roller which contacts the outer surface of the carrier at the start of the wrapping and drives the carrier through frictional engagement between the driven roller and the carrier. As layers of yarn are wrapped onto the carrier, the driven roller moves radially outward from the carrier, maintaining frictional contact with the outer layer of yarn. A pick-up groove is usually provided at one end of the tube for capturing the yarn and initiating the wrapping of the yarn onto the tube.

Often the carrier or tube is formed by spirally winding a number of plies together. Constructing a carrier or tube which can withstand the significant forces associated with the wrapping of yarn, especially carpet yarn fibers, at high speed has proven challenging. The assignee of the present invention has disclosed several techniques and structures for addressing this challenge in U.S. Pat. No. 4,462,556 to Graham Jr., U.S. patent No. RE33,060 to Cunningham et al., U.S. Pat. No. 5,505,395 to Qiu et al., U.S. Pat. No. 5,393,582 to Wang et al., and U.S. Pat. No. 5,472,154. The entire contents of each preceding patent are hereby incorporated by reference.

A wide variety of yarns and other textile materials are used to produce an array of textile products. Unfortunately, many textile yarns are not easily distinguishable from one another. Therefore, one important feature of a yarn tube is the means for identifying the particular type of yarn on the tube without a detailed inspection of the yarn. A visual symbol or identification mark is often applied to the rim of the tube, above the yarn wrapped thereon. These markings may be a printed symbol on the ends of the tube. A particularly useful means for yarn identification is to color code the carriers with one or more colored bands on their outer peripheral surfaces. Multiple bands are preferred because they can convey more information than a single colored band. For example, one band may be used to designate the yarn material and another may be used to designate the denier of the yarn. Moreover, providing various combinations of colors allow a greater number of yarns to be identified than if one band was used.

Placing yarn identifying markings on the outer peripheral surface of the carrier exposes them to significant wear from frictional contact with the driven roller during the start of the wrapping operation, the wrapping of the first layer of yarn onto the carrier, or handling of the carrier while empty. The wearing away of the markings can produce dust that could contaminate the yarn and could collect on the parts of the wrapping machine, which would require more frequent maintenance and increased risk of failure. In addition, after prolonged use, the markings may wear away completely, requiring the markings to be reapplied or new carriers to be provided more often than desired.

Another marking technique is to color the outer layer of the tube as generally described in U.S. Pat. No. 6,851,643 to Qiu et al. and assigned to the same assignee as the present application, the entire contents of which are hereby incorporated by reference. However coloring the outer layer is expensive and sometimes interferes with the ability to construct an outer layer that can withstand the forces associated with the wrapping forces.

Therefore, a need exists for a spirally wound yarn tube or carrier with a identification feature which can withstand the forces of the yarn manufacturing process. Furthermore, it would be advantageous for such a tube to be the product of a cost effective process.

BRIEF SUMMARY OF THE INVENTION

The present invention addresses the above needs and achieves other advantages by providing a spirally wound tube for wrapping textiles or other materials thereon. The tube has an identification feature. In general, the tube is made by spirally winding a number of plies together. The outermost ply defines a groove that substantially extends spirally along the length of the tube. The groove is for containing an identification marking for identifying the textile or other material wrapped onto the tube.

According to one embodiment of the present invention, the tube comprises a tubular body and an identification stripe. The tubular body extends lengthwise between a first end and a second end and defines an outer surface and a groove. The groove has a bottom or marking surface that is substantially parallel to the outer surface and substantially extends spirally from the first end to the second end. The groove also has opposing side walls that define a width and depth of the groove. The identification stripe is for providing identification of the textile or other material wrapped onto the tube. The stripe extends substantially along the bottom surface of the groove.

The identification stripe may be attached to the bottom surface by an adhesive. Also, the thickness of the stripe may be less than the depth of the groove so that the stripe is contained between the bottom surface and the outer surface. Although the width of the identification stripe may vary, according to one embodiment, the stripe is approximately half the width of the groove. The identification stripe may identify the wrapped textile or other material in a variety of way. For example purposes, the identification stripe may be of a specific color and/or display a variety of readable indicia for identifying the material. Alternatively, according to some embodiments, the tube may have more than one identification stripe, in which the combination of the stripes serves to identify the wrapped materials.

One aspect of the present invention is a method of constructing the tube with the identification feature. The method includes forming a groove into a ply such that the groove substantially extends along the length of the ply. The manner in which the groove is formed may vary. However, according to one embodiment, the groove is formed by a ply press which presses a portion of the ply to form the groove. Preferably, the groove is formed approximately at the center of the ply. The method also includes spirally winding the ply with the groove about a forming mandrel to form the tubular body of the tube and then spirally winding the identification stripe into the groove.

In one embodiment, additional plies are spirally wound to form one or more inner layers of the tubular body and the ply with the groove forms the outer layer and defines the outer surface of the tube. Also, the identification stripe may be adhered to the bottom surface of the groove by an adhesive.

The present invention has several advantages. For example, the spirally extending identification stripe or stripes provide a cost effective method of providing an effective identification feature to a textile carrier or tube. Furthermore, the use of a separate identification stripe allows for the outermost ply to be optimized for withstanding wrapping forces instead of adapting for a marking system, such as coloring the entire outermost ply or providing a writable surface. Also, containing the identification stripe inward of the outer surface protects the identification stripe from wear caused by the wrapping process and protects the textile material from the identification stripe.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
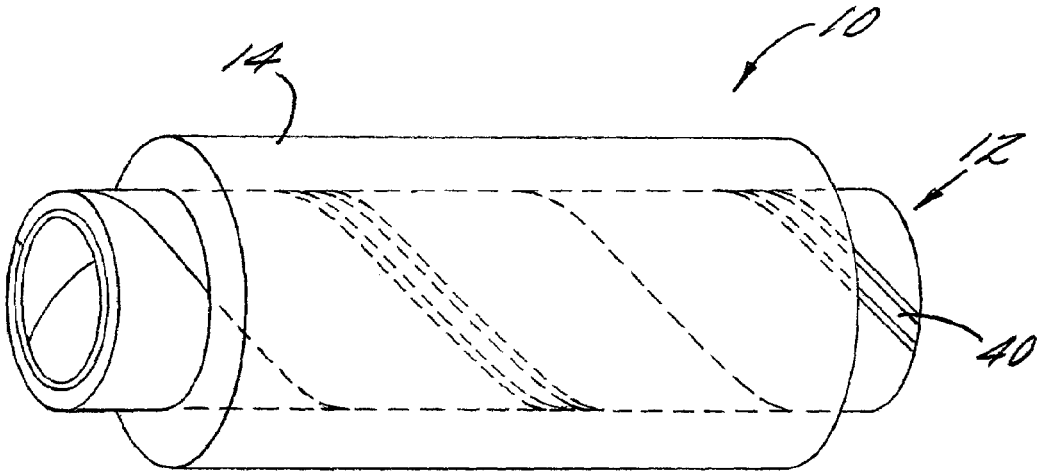
FIG. 1 is a perspective view of a textile package, including a tube according to one embodiment of the present invention with a textile material wrapped thereon.
Figure 2:
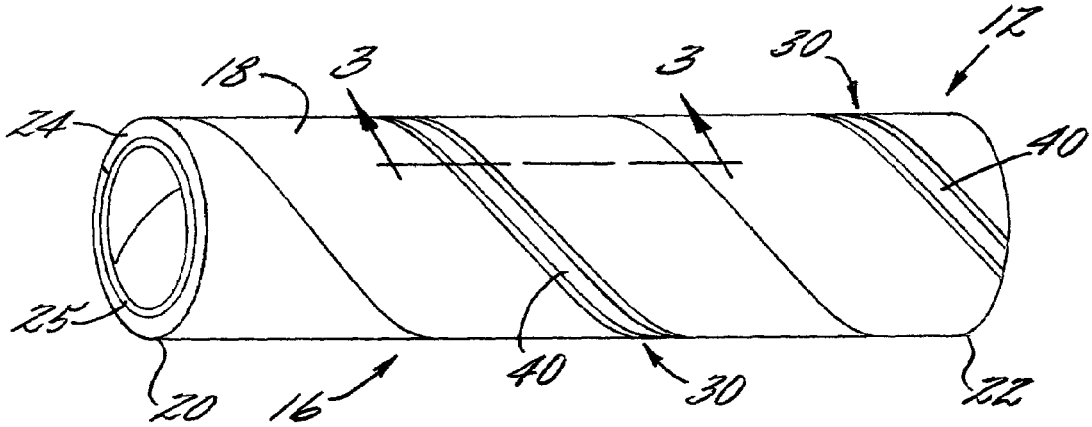
FIG. 2 is a perspective view of the tube illustrated in FIG. 1 without the yarn.

FIG. 1 shows a textile package 10 including a carrier or tube 12, according to one embodiment of the present invention with the textile material 14 wrapped around the tube 12. Textile material includes any fiber or yarn for making fabric. For example, the textile material 14 may be carpet yarn. In general, the tube 12 includes a body 16 configured to withstand the significant forces associated with the wrapping of the textile material 14 around the body 16. Typically the body 16 is tubular in shape and is formed by spirally winding a number of plies about a forming mandrel. The strength of the tubular body 16 is dependent on several factors including the number of plies, the strength of the individual plies, the number of layers in the body, the angle at which the plies are wound, and the tension of the plies. Another important consideration is the outer surface 18 of the tubular body 16. The outer surface 18 undergoes significant stresses during the wrapping of the textile material 14, especially during the initial wraps. Furthermore, the outer surface 18 should remain relatively smooth and substantially free of "fuzz" in order to facilitate the transfer of the textile material 14 to and from the tube 12. Therefore it is preferable that the outer surface 18 has enough strength to resist the wrapping forces while having enough energy absorbing capacity to maintain a relatively smooth and remains substantially fuzz free over time.

The body 16 extends lengthwise between a first end 20 and a second end 22. Although the body 16 may be formed by one ply, it is preferable that the body 16 is formed by a plurality of plies. An outermost ply 24 forms an outer layer of the body 16 and defines the outer surface 18 and a groove 30. Additional plies 25 form one or more inners layers of the body 16. The plies 25 forming the inner layers and the outermost ply 24 may vary. For example, the plies 24, 25 may be constructed from different material, have different dimensions, or be wound at different angles.

Figure 3:
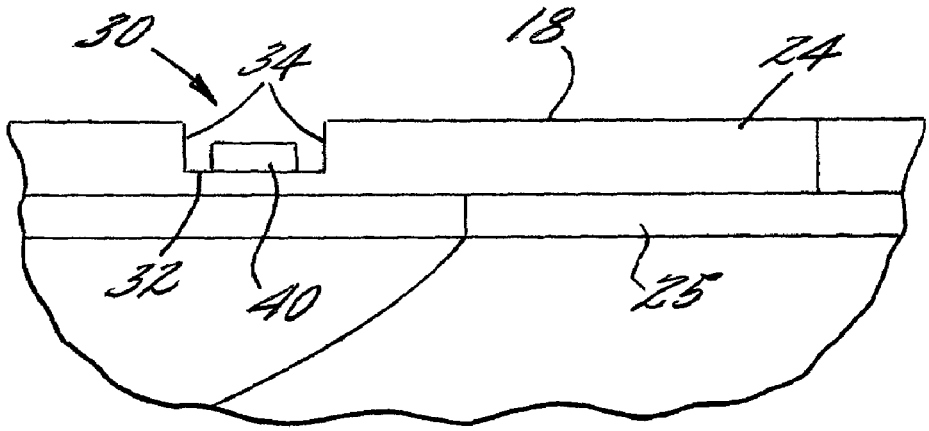
FIG. 3 is an enlarged cross-section view of a portion of the tube in FIG. 2 taken along line 3-3.
Figure 4:
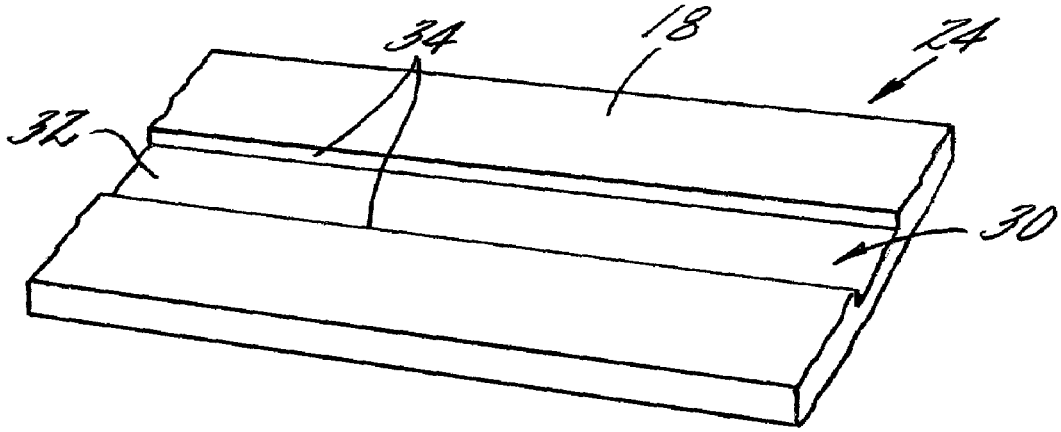
FIG. 4 is a portion of the outermost ply before it is spirally wound to form part of the tube.

As best seen in FIGS. 3 and 4, the groove 30 defined by the outermost ply 24 includes a bottom surface 32 and two opposing side walls 34. Generally, the groove 30 extends along the length of the ply 24 and is substantially parallel to the edges of the ply 24. Therefore as the outermost ply 24 is spirally wound to form the outer layer, the groove 30 substantially extends spirally from the first end 20 to the second end 22 of the tube 12.

The bottom surface 32 is radially inward of the outer surface 18. Preferably, the bottom surface is parallel to the outer surface 18. The opposing side walls 34 define the width and depth of the groove 30. Although the side walls 34 are illustrated as being generally perpendicular to the bottom surface 32, the angle orientation between the side walls 34 and bottom surface 32 may vary if desired.

In one embodiment, the bottom surface 32 functions a marking surface. In particular, the bottom surface 32 may be directly marked with a specific color, pattern, readable indicia, or any combination of markings that indicate the type or nature of the textile material 14 intended to be wrapped or is wrapped around the tube 12.

Alternatively and preferably, instead of marking the bottom surface 32 directly, the tube 12 may also include an identification stripe 40. More specifically, the identification stripe 40 extends substantially along the bottom surface 32. For example, the identification stripe 40 may be attached to the bottom surface 32 by an adhesive or by a press fit. The identification stripe 40 contains a marking system or identification markings to indicate the type or nature of the textile material 14 wrapped around the tube 12. Again, the marking system may include, but not limited to, the color or colors of the stripe 40, or patterns, codes, readable indicia, or any combination of markings on the stripe 40.

Alternatively, the tube 12 may include two or more identification stripes 40 for identifying the wrapped material 14. Each stripe 40 extends substantially along the bottom surface in a side-by-side fashion allowing each stripe 40 to be substantially visible and the combination of the stripes 40 indicates the wrapped textile material 14.

The identification stripe or stripes 40 are preferred over marking the bottom surface 32. Due to the desired characteristics of the outermost ply 24 to withstand the forces of the wrapping process, the outermost ply 24, in some embodiments, may not support markings directly onto its surfaces, including the bottom surface 32 of the groove 30.

Although the width of the identification stripe 40 may vary relative to the width of the groove 30, it is preferable that the width of the identification stripe 40 is significantly less than the width of the groove 30. A relatively smaller width for the identification stripe 40 makes its insertion into the groove 30 easier and reduces any risk of damaging the outer surface 18 during the insertion.

It is also preferable that the thickness of the identification stripe 40 is less than the depth of the groove 30. A relatively smaller thickness of the stripe 40 to the depth of the groove 30 allows for the identification stripe 40 to be contained between the outer surface 18 and the bottom surface 32. Therefore, no part of the identification stripe 40 extends radially outward of the outer surface 18 and reduces possible interference with the wrapping of the textile material 14.

Another aspect of the present invention is a method or process of forming the tube 12. The method includes forming the groove 30 into a ply 24 such that the groove 30 substantially extends along the length of the ply 24, as best seen in FIG. 4. The manner in which the groove 30 is formed may vary. However, according to one embodiment, the groove 30 is formed by a ply press which presses a portion of the ply 24 to form the groove 30. Preferably, the groove 30 is formed approximately at the center of the ply 30. The method also includes spirally winding the ply 30 with the groove 30 about a forming mandrel 50 to form the tubular body 16 of the tube 12 and then spirally winding the identification stripe 40 into the groove 30.

Figure 5:
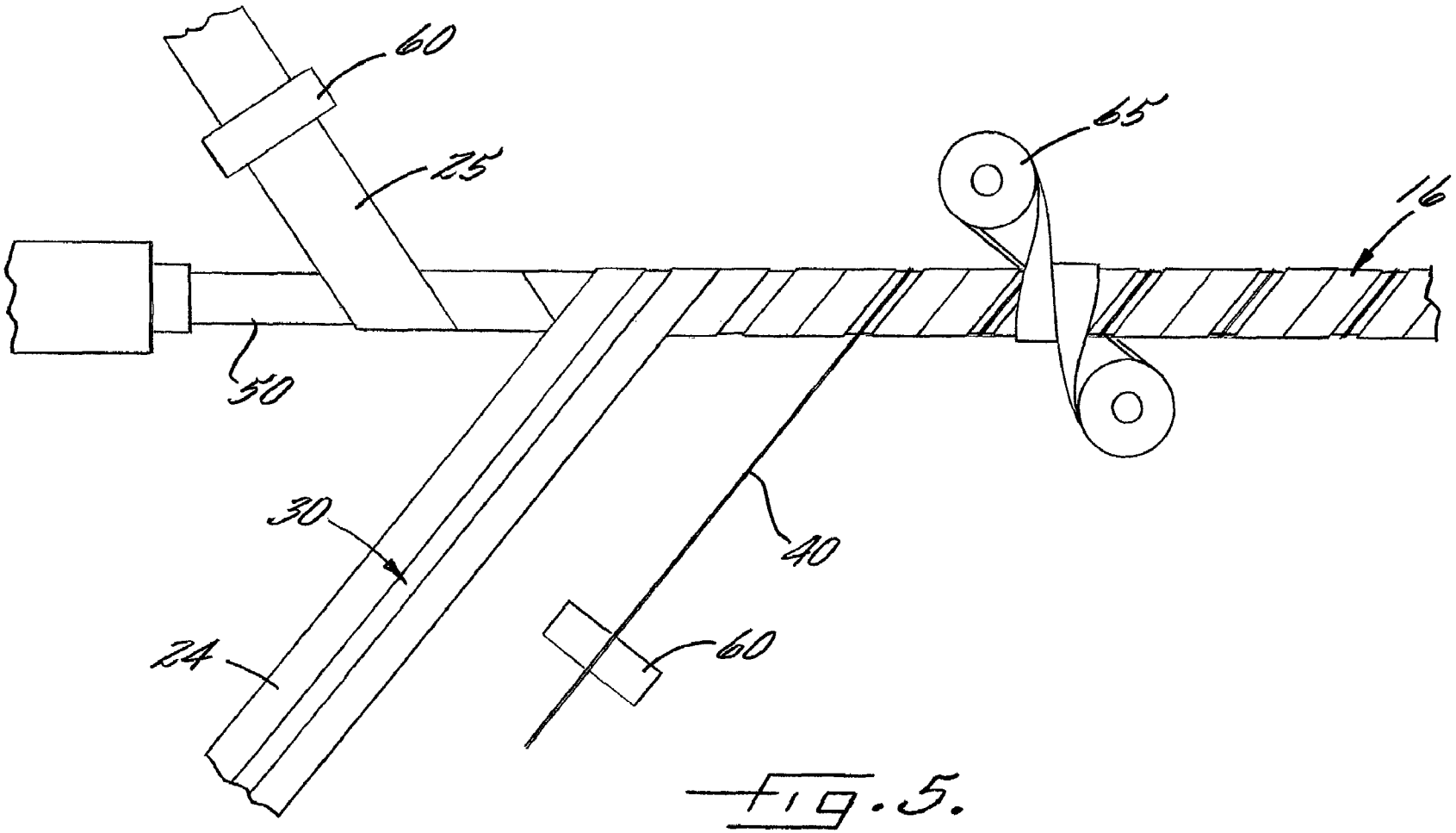
FIG. 5 is a diagrammatic top elevation of an apparatus for forming a tube as shown in FIGS. 1 through 4, showing the plies and identification stripe being wound about a forming mandrel.

In particular, according to one embodiment and as shown in FIG. 5, one additional ply 25 is routed to and spirally wound about the forming mandrel 50 to form an inner layer of the tubular body 16. It should be understood that the number of additional plies 25 used to form the inner layer or layers of the tubular body 16 may vary. Next, the outermost ply 24 defining the outer surface 18 of the tubular body 16 is routed to and spirally wound about the forming mandrel 50 to form the outer layer of the continuous tubular body 16 such that the groove 30 is facing outwardly. Further downstream, the identification stripe 40 is routed to and spirally wound about the forming mandrel 50. More specifically, the identification stripe 40 is spirally wound along the groove 30 such that it extends substantially along the bottom surface 32 of the groove 30. A cut-off station (not shown) may be included to cut the continuous tubular body 16 into discrete lengths to form individual tubes 12. A winding belt 65 rotates the continuous tubular body 16 in a screw fashion such that the body 16 advances down the mandrel 50. As shown, the identification stripe 40 may have an adhesive applied to it at an adhesive applying station 60 such as a glue pot before being spirally wound in the groove 30. The adhesive attaches the identification stripe 40 to the bottom surface 32. Similarly, an adhesive may be applied, as shown, to the additional ply 25 for adhering the inner layer and outer layer together.

The present invention has several advantages. For example, the spirally extending identification stripe or stripes 40 provide a cost effective method of providing an effective identification feature to a textile carrier or tube 12. Furthermore, the use of a separate identification stripe 40 allows for the outermost ply 24 to be optimized for withstanding wrapping forces instead of adapting for a marking system, such as coloring the entire outermost ply 24 or providing a writable surface. Also, containing the identification stripe 40 inward of the outer surface 18 protects the identification stripe 40 from wear caused by the wrapping process and protects the textile material 14 from the identification stripe 40.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A spirally wound tube for wrapping textiles or other materials thereon and having an identification feature, said tube comprising:

a tubular body that includes a plurality of plies and extends lengthwise between a first end and a second end, wherein the outermost ply defines an outer surface and a groove, and wherein the groove has a bottom surface substantially parallel to the outer surface and opposing side walls to define a width and depth, and the bottom surface substantially extends spirally from the first end to the second end; and an identification stripe for identifying the textile or other material wrapped onto the tube, the identification stripe extending substantially along the bottom surface of the groove.

2. The tube according to claim 1, wherein the identification stripe defines a width that is approximately one half the size of the width defined by the opposing side walls.

3. The tube according to claim 1, wherein the identification stripe defines a thickness that is less than the depth defined by the opposing side walls, such that the identification stripe is contained between the outer surface and the bottom surface.

4. The tube according to claim 1, wherein a color of the identification stripe indicates the textile or other material wrapped onto the tube.

5. The tube according to claim 1, wherein the identification stripe includes readable indicia about the textile or other material wrapped onto the tube.

6. The tube according to claim 1, further comprising a plurality of identification stripes for identifying the textile or other material, wherein the identification stripes extend substantially along the bottom surface in a side-by-side fashion, such that each identification stripe is substantially visible.

7. A textile tube on which yarn is wrapped to form a package, said tube having an identification feature and comprising:

a spirally wound ply forming an outer layer of said tube extending between a first end and second end and defining an outer surface, the spirally wound ply defining a groove extending the length of the ply substantially near the center of the ply, such that the groove extends spirally between the first end and the second end, wherein the groove defines a marking surface substantially parallel to the outer surface for supporting an identification marking of the yarn and two opposing side walls to define a width and depth.

8. The tube according to claim 7, wherein the marking surface is substantially colored in order to identify the yarn.

9. The tube according to claim 8, wherein the marking surface is colored by a identification stripe having an identifying color.

10. The tube according to claim 9, wherein the identification stripe is attached to the marking surface by an adhesive.

11. The tube according to claim 7, further comprising at least a second spirally wound ply forming at least one inner layer of the tube, wherein the outer layer and the at least one inner layer are adhered together.

12. A yarn tube configured to have yarn wrapped thereon to form a yarn package, said yarn tube comprising:

a plurality of plies spirally wound together to form a tubular body, including an outermost ply that defines an outer surface, a length of the tubular body, and a groove, wherein the groove has a bottom surface substantially parallel to the outer surface and opposing side walls to define a width and depth, and extends spirally substantially along the length of the body; and an identification stripe for identifying the yarn wrapped onto the tube, the identification stripe extending substantially along the bottom surface of the groove and having a width and a thickness.

13. The yarn tube according to claim 12, wherein the width of the identification stripe is approximately half the width defined by the side walls and the thickness of the identification stripe is less than the depth defined by the opposing side walls, such that the identification stripe is contained between the outer surface and the bottom surface.

14. The yarn tube according to claim 12, wherein the identification stripe is attached to the bottom surface by an adhesive.

15. The yarn tube according to claim 12, wherein a color of the identification stripe indicates the yarn wrapped onto the tube.

16. The yarn tube according to claim 12, wherein the identification stripe includes readable indicia about the yarn wrapped onto the tube.

17. A method of constructing a tube for wrapping textiles or other materials thereon, wherein the tube has an identification feature, the method comprising:

forming a groove into a first ply, wherein the groove substantially extends along the length of the first ply;

spirally winding at least a second ply about a forming mandrel to form at least one inner layer of a tubular wall;

spirally winding the first ply about the forming mandrel, wherein the first ply forms the outer layer of the tubular wall; and spirally winding an identification stripe into the groove.

18. The method according to claim 17 further comprising:

adhering the identification stripe to a bottom surface of the groove with an adhesive.

19. A method of constructing a yarn tube having an identification feature, the method comprising:

forming a groove into an outermost ply wherein the groove extends substantially parallel to a length of the outermost ply;

spirally winding at least one inner ply about a forming mandrel to form at least one inner layer of the yarn tube;

spirally winding the outermost ply about the forming mandrel such that the groove is facing an outer surface of the yarn tube; and spirally winding an identification stripe into the groove such that the identification stripe is contained between a bottom surface of the groove and the outer surface.

20. The method according to claim 19, wherein the step of forming a groove into an outermost ply includes using a press to form the groove.

21. The method according to claim 19, wherein the groove is formed approximately along a center of the outermost ply.

22. A system comprising:

a plurality of spirally wound tubes for wrapping textiles or other materials thereon, each tube comprising:

a tubular body that includes a plurality of plies and extends lengthwise between a first end and a second end wherein the outermost ply defines an outer surface and a groove, and wherein the groove has a bottom surface substantially parallel to the outer surface and opposing side walls to define a width and depth, the bottom surface substantially extending spirally from the first end to the second end; and an identification stripe for identifying the textile or other material wrapped onto the tube, the identification stripe extending substantially along the bottom surface of the groove, wherein the identification stripe of a first tube carrying a first textile or other material differs from the identification stripe of a second tube carrying a second textile or other material that is different from the first textile or other material, such that the identification stripe of each tube permits distinguishing between different textiles or other material respectively wound about the tubes.

23. The system according to claim 22, wherein a color of the identification stripe indicates the textile or other material wrapped onto the respective tube.

24. The system according to claim 22, wherein the identification stripe includes readable indicia about the textile or other material wrapped onto the respective tube.

25. The system according to claim 22, wherein each tube comprises a plurality of identification stripes for identifying the respective textile or other material and wherein the identification stripes of each tube extend substantially along the bottom surface in a side-by-side fashion, such that each identification stripe on the respective tube is substantially visible.

* * * * *